US007962052B2

(12) United States Patent
Ishino

(10) Patent No.: US 7,962,052 B2
(45) Date of Patent: Jun. 14, 2011

(54) FIXING DEVICE, IMAGE FORMING APPARATUS, RECORDING MEDIUM AND FIXING TREATMENT METHOD

(75) Inventor: Masahiro Ishino, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 33 days.

(21) Appl. No.: 12/582,343

(22) Filed: Oct. 20, 2009

(65) Prior Publication Data

US 2010/0209122 A1 Aug. 19, 2010

(30) Foreign Application Priority Data

Feb. 13, 2009 (JP) ..... 2009-031300

(51) Int. Cl.
*G03G 15/00* (2006.01)
*G03G 15/20* (2006.01)

(52) U.S. Cl. ..... 399/12; 399/67; 399/69

(58) Field of Classification Search ..... 399/12, 399/27, 67–70
See application file for complete search history.

(56) References Cited

U.S. PATENT DOCUMENTS

| | | | | |
|---|---|---|---|---|
| 6,751,424 | B2 * | 6/2004 | Itakura et al. | 399/68 |
| 6,819,881 | B2 * | 11/2004 | Kurita et al. | 399/12 |
| 7,286,781 | B2 * | 10/2007 | Koido | 399/67 |
| 2004/0101320 | A1 | 5/2004 | Haramoto | |
| 2005/0078165 | A1 | 4/2005 | Harada et al. | |
| 2005/0078969 | A1 | 4/2005 | Kikuchi | |
| 2008/0022053 | A1 | 1/2008 | Kikuchi | |

FOREIGN PATENT DOCUMENTS

| | | |
|---|---|---|
| JP | 1-221764 | 9/1989 |
| JP | 2-211471 | 8/1990 |
| JP | 10-177313 | 6/1998 |
| JP | 2000-356870 | 12/2000 |
| JP | 2001-337567 | 12/2001 |
| JP | 2002-318511 | 10/2002 |
| JP | 2004-170863 | 6/2004 |
| JP | 2005-070315 | 3/2005 |
| JP | 2005-115054 | 4/2005 |
| JP | 2006-039443 | 2/2006 |
| JP | 2007-232973 | 9/2007 |
| JP | 2008-170585 | 7/2008 |

* cited by examiner

*Primary Examiner* — Hoang Ngo
(74) *Attorney, Agent, or Firm* — Morgan, Lewis & Bockius LLP

(57) ABSTRACT

A fixing device of the present invention is equipped with a heated body whose fixing temperature applied to toner is changed and which is heated in accordance with a type of toner that has been discriminated by a toner type discriminating unit that discriminates types of toner classified at least as a result of their melting points differing. When toner with a relatively high melting point has been used, the fixing device is rotated on the basis of a limiting control unit that limits a number of sheets of recording paper that can be continuously fixed.

22 Claims, 6 Drawing Sheets

FIXING DEVICE, IMAGE FORMING APPARATUS, RECORDING MEDIUM AND FIXING TREATMENT METHOD

CROSS-REFERENCE TO RELATED APPLICATION

This application is based on and claims priority under 35 USC 119 from Japanese Patent Application No. 2009-031300 filed Feb. 13, 2009.

BACKGROUND

1. Technical Field

The present invention relates to a fixing device, an image forming apparatus, a recording medium and a fixing treatment method.

2. Related Art

Among image forming apparatus that use toner as a developer to form an image on the basis of an original image, there is known an image forming apparatus where, for example, in a state where an electrostatic latent image has been formed on a photoconductor drum on the basis of the original image (e.g., image data), a toner image is created by supplying at least toner, the toner image is transferred onto recording paper, and a fixing treatment is administered.

In the fixing treatment, a pressure and heat treatment is done with respect to the recording paper (toner image), and the heating temperature—that is, the fixing temperature—at this time is set on the basis of the melting point of the toner.

SUMMARY

The present invention provides a fixing device that can, even with toner whose melting points differ, perform a fixing treatment corresponding to the melting points of that toner and continue image formation processing.

A first aspect of the invention is a fixing device including: a heated body whose fixing temperature applied to toner is changed and which is heated in accordance with a type of toner that has been discriminated by a toner type discriminating unit that discriminates types of toner classified at least as a result of their melting points differing, wherein when toner with a relatively high melting point has been used, the fixing device is rotated on the basis of a limiting control unit that limits a number of sheets of recording paper that can be continuously fixed.

BRIEF DESCRIPTION OF THE DRAWINGS

An exemplary embodiment of the present invention will be described in detail based on the following figures, wherein.

DETAILED DESCRIPTION

Figure 1:
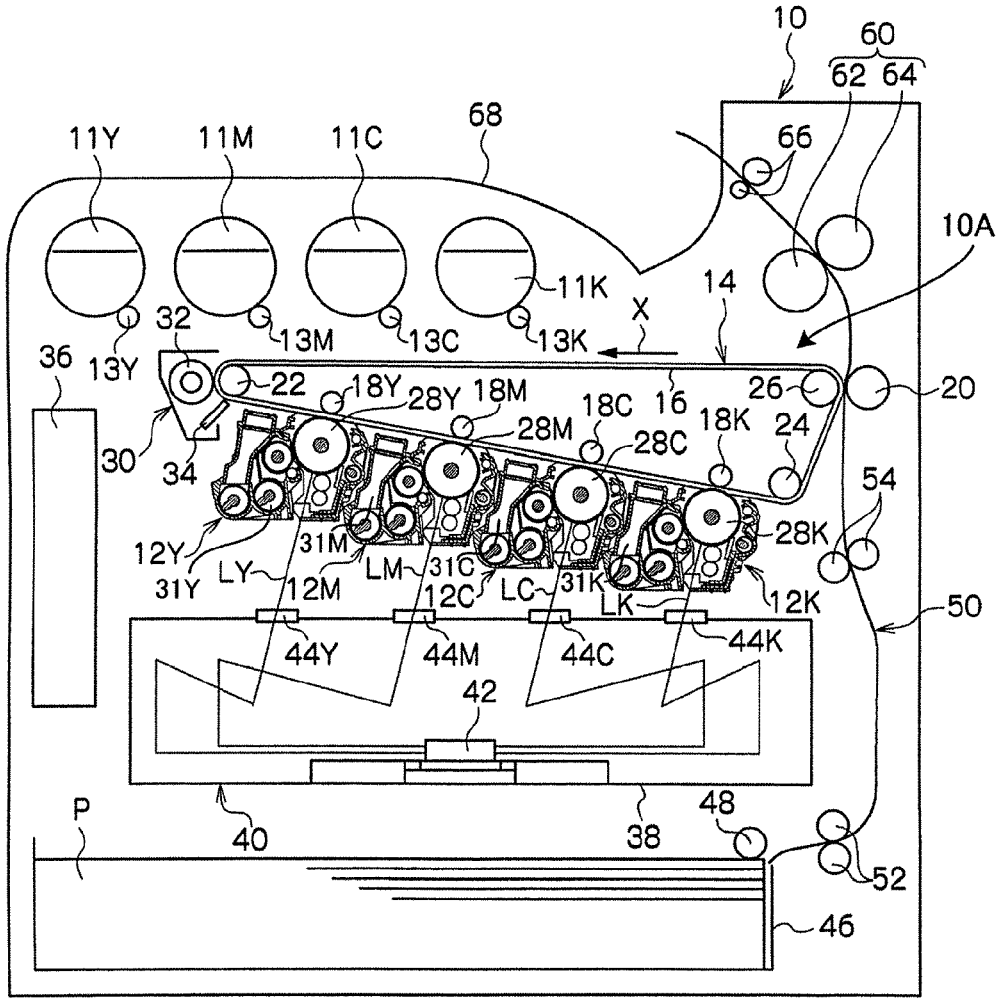
FIG. 1 is a general configural diagram of a printer pertaining to the exemplary embodiment.

In FIG. 1, there is shown a printer 10 that serves as an image forming apparatus. The printer 10 is a digital printer that forms a full-color image or a black-and-white image.

In the upper portion of a printer engine section 10A inside the printer 10, toner cartridges 11Y, 11M, 11C and 11K that hold yellow (Y), magenta (M), cyan (C) and black (K) toner are disposed such that they are replaceable.

The toner cartridges 11Y, 11M, 11C and 11K of each color of YMCK are loaded into a loading section 10B (see FIG. 3) disposed in the printer engine section 10A. The toner cartridges 11Y, 11M, 11C and 11K are loadable into and unloadable from the loading section 10B and are configured such that they are replaced by a user when two-component developers filling the insides of the toner cartridges run out.

One end each of toner supply paths 13Y, 13M, 13C and 13K is respectively connected to the toner cartridges 11Y, 11M, 11C and 11K. It will be noted that the toner supply paths 13Y, 13M, 13C and 13K are configured by circular tube members and are arranged facing downward along a side surface of the printer 10, but illustration of their midstream paths is omitted.

Further, in the center of the inside of the printer 10, four image forming units 12 (12Y, 12M, 12C and 12K) corresponding to the Y, M, C and K two-component developers are arranged in a state where they partially overlap each other to the right and diagonally downward when seen in the front view of FIG. 1.

The image forming units 12 are equipped with photoconductors 28. Around the photoconductors 28, there are disposed charging rolls that serve as one example of charging devices that contact surfaces of the photoconductors 28 and uniformly charge the photoconductors 28, developing units 31 that develop, with the two-component developers (a toner and a carrier) of each color, electrostatic latent images that have been formed on the photoconductors 28 by later-described exposure light beams L, erase lamps that serve as one example of neutralizing devices that irradiate the surfaces of the photoconductors 28 after transfer with light to perform neutralization, and cleaning units that clean the surfaces of the photoconductors 28 after neutralization.

The two-component developers comprise a mixture of a nonmagnetic type of toner and a magnetic carrier. Here, the other ends of the toner supply paths 13Y, 13M, 13C and 13K are respectively connected to the four image forming units 12Y, 12M, 12C and 12K such that toner of each color and a small quantity of the carrier are supplied to each of the image forming units 12. It will be noted that the combination ratio of toner and carrier differs depending on the processing specification of the printer 10, but the toner-to-carrier ratio is about 9:1. On the other hand, originally, the combination ratio of toner and carrier of the two-component developers present inside the developing units 31 differs depending on the processing specification of the printer 10, but the toner-to-carrier ratio is about 1:9.

A transfer unit 14 is disposed above the image forming units 12Y, 12M, 12C and 12K. The transfer unit 14 has an intermediate transfer belt 16, primary transfer rolls 18Y, 18M, 18C and 18K that serve as four primary transfer members that are disposed inside the intermediate transfer belt 16 and cause the toner images of the image forming units 12Y, 12M, 12C and 12K to be multiply transferred onto the intermediate transfer belt 16, and a secondary transfer roll 20 that causes the toner images that have been superposed on the intermediate transfer belt 16 to be transferred onto recording paper P.

The intermediate transfer belt 16 is wrapped with a constant tension around a roll group configured by a drive roll 22 that is driven by an unillustrated motor, a tension roll 24 that adjusts the tension in the intermediate transfer belt 16 and a backup roll 26 that is disposed facing the secondary transfer roll 20, and the intermediate transfer belt 16 is configured so as to be driven by the drive roll 22 around in the direction of arrow X in FIG. 1 (in a counter-clockwise direction).

The primary transfer rolls 18Y, 18M, 18C and 18K are disposed facing the photoconductors 28 (28Y, 28M, 28C and 28K) of the respective image forming units 12Y, 12M, 12C and 12K, with the intermediate transfer belt 16 being sandwiched between the primary transfer rolls 18 and the photoconductors 28. Further, a transfer bias voltage of the opposite polarity (in the present exemplary embodiment, positive polarity as one example) of the toner polarity is applied to the primary transfer rolls 18Y, 18M, 18C and 18K by a power feed unit (not shown). It will be noted that a transfer bias voltage of the opposite polarity of the toner polarity is imparted to the transfer roll 20 also by the power feed unit.

Further, a cleaning device 30 is disposed on the outer peripheral surface of the intermediate transfer belt 16 in the position where the drive roll 22 is disposed. The cleaning device 30 is equipped with a cleaning brush 32 and a cleaning blade 34, and the cleaning device 30 uses the cleaning brush 32 and the cleaning blade 34 to remove residual toner and paper dust on the intermediate transfer belt 16.

A control unit 36 that performs drive control of each unit of the printer 10 is disposed in the vicinity of a side surface of the printer 10 on the opposite side of a conveyance path of the recording paper P. Further, an exposure unit 40 that irradiates the charged surfaces of the photoconductors 28 with exposure light beams L (LY, LM, LC and LK) corresponding to each color to form the electrostatic latent images is disposed below the image forming units 12.

The exposure unit 40 is configured by a single unit that is common to the four image forming units 12Y, 12M, 12C and 12K. The exposure unit 40 is configured to modulate four semiconductor lasers (not shown) in accordance with color material tone data and emit the exposure light beams LY, LM, LC and LK from these semiconductor lasers in accordance with the tone data. It will be noted that the exposure unit 40 may also be disposed individually for each of the image forming units 12.

Further, the exposure unit 40 is hermetically sealed in a rectangular frame 38, and fθ lenses (not shown) and a polygon mirror 42 for scanning each of the exposure light beams L in a main scanning direction are disposed inside the frame 38. Glass windows 44Y, 44M, 44C and 44K for emitting the four exposure light beams LY, LM, LC and LK toward the photoconductors 28 of the image forming units 12Y, 12M, 12C and 12K are disposed in the top surface of the frame 38.

Here, the polygon mirror 42 is irradiated with the exposure light beams LY, LM, LC and LK that have been emitted from the semiconductor lasers of the exposure unit 40, and the light beams reflected from this polygon mirror 42 are deflected and scanned via the fθ lenses. The exposure light beams LY, LM, LC and LK that have been deflected and scanned by the polygon mirror 42 are scanned on exposure points on the photoconductors 28 via optical systems (not shown) comprising imaging lenses and plural mirrors.

On the underside of the exposure unit 40, there is disposed a paper supply cassette 46 in which the recording paper P is stored. Further, a paper conveyance path 50 that conveys the recording paper P is disposed leading upward in the vertical direction from the end portion of the paper supply cassette 46.

In the paper conveyance path 50, there are disposed a paper supply roll 48 that feeds the recording paper P from the paper supply cassette 46, a roll pair 52 for paper separation conveyance that causes the recording paper P to be supplied one sheet at a time, and paper leading edge aligning rolls 54 that cause the conveyance timing of the recording paper P to match the moving timing of an image on the intermediate transfer belt 16. Here, the recording paper P that has been sequentially fed by the paper supply roll 48 from the paper supply cassette 46 is conveyed, via the paper conveyance path 50, to a secondary transfer position of the intermediate transfer belt 16 by the paper leading edge aligning rolls 54 that intermittently rotate, and then the recording paper P is stopped.

Above the secondary transfer roll 20, there is disposed a fixing device 60. The fixing device 60 is equipped with a heated heat roll 62 that serves as one example of a heated body and a pressure roll 64 that pressure-contacts this heat roll 62. The heat roll 62 and the pressure roll 64 are driven to rotate by an unillustrated motor and gear train. The heat roll 62 is driven to rotate by driving force transmitted via the gear train from the motor, and the pressure roll 64 that is disposed so as to pressure-contact the heat roll 62 rotates in accompaniment therewith. Here, the recording paper P to which the toner images of each color have been transferred by the secondary transfer roll 20 is heated and pressurized by heat and pressure in the pressure-contact portion between the heat roll 62 that is driven to rotate and the pressure roll 64, the toner images are fixed to the recording paper P, and the recording paper P is discharged into a discharge tray 68 disposed in the upper portion of the printer 10 by discharge rolls 66 that serve as one example of a discharge device disposed downstream in the conveyance direction of the recording paper P. Further, residual toner and paper dust are removed by the cleaning device 30 from the surface of the intermediate transfer belt 16 for which the step of secondarily transferring the toner images has ended. It will be noted that the pressure roll 64 may also be driven to rotate via the gear train rather than rotating in accompaniment with respect to the heat roll 62. Further, a belt-like pressurized body may also be used instead of the pressure roll 64.

Figure 2:
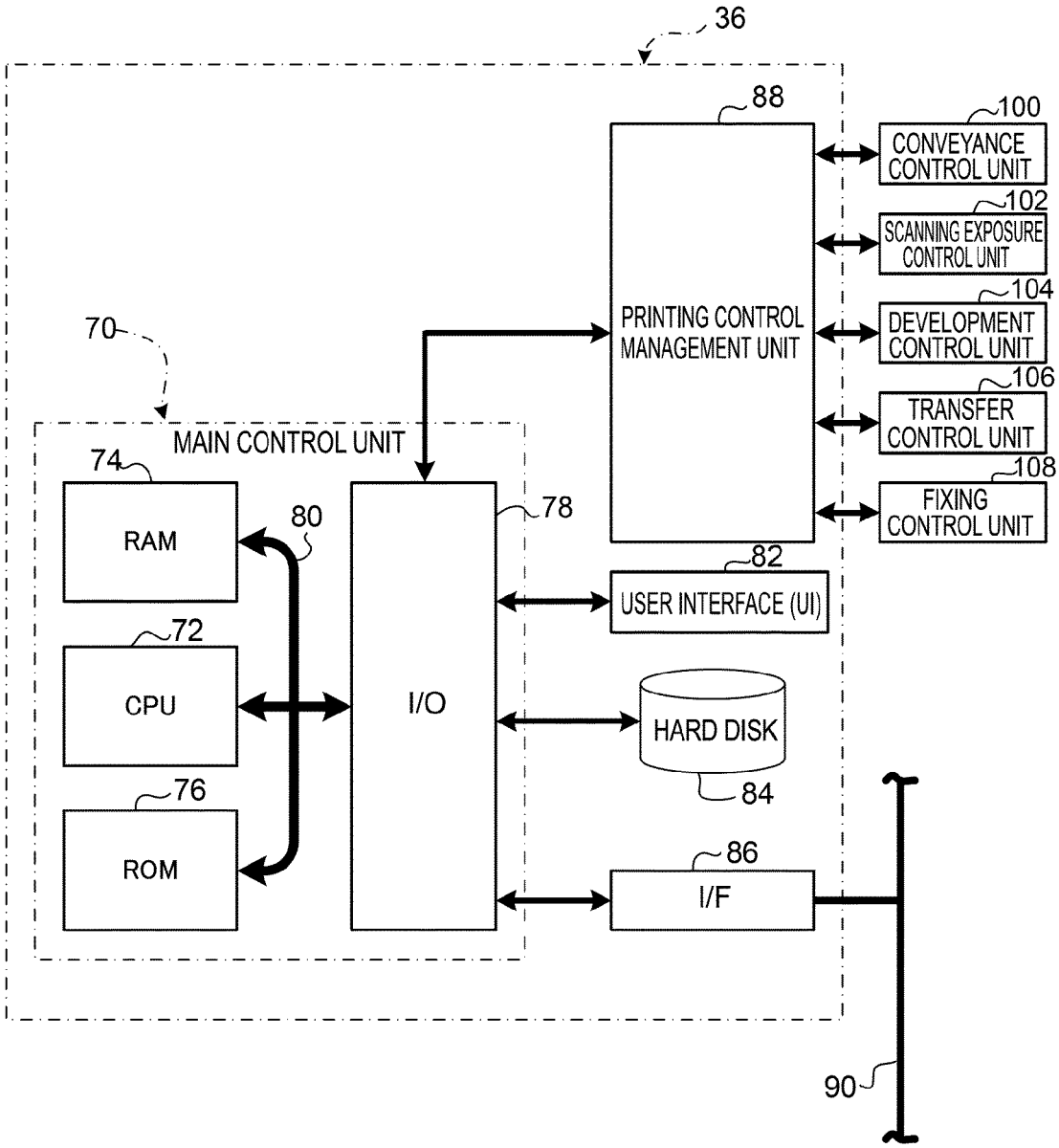
FIG. 2 is a block diagram showing the hardware configuration of a control unit in the printer pertaining to the exemplary embodiment.

As shown in FIG. 2, the control unit 36 includes a main control unit 70. The main control unit 70 has a CPU 72, a RAM 74, a ROM 76, an I/O (input/output) 78 and a bus 80 such as a data bus or a control bus that interconnects these.

A printing control management unit 88 for controlling and managing each processing system in the printer 10, such as the conveyance system and the scanning exposure system and developing system for image formation, is connected to the I/O 78.

More specifically, a conveyance control unit 100, a scanning exposure control unit 102, a development control unit 104, a transfer control unit 106 and a fixing control unit 108 are connected to the printing control management unit 88, and the printing control management unit 88 manages control of each unit.

The printing control management unit 88 may also have a configuration where it is directly connected to the bus 80 rather than the I/O 78. Further, here, the control unit 36 is given a configuration where control relating to printing is consolidated in the printing control management unit 88, but it may also have a configuration where that control is executed in the main control unit 70.

Further, a UI (user interface) 82 is connected to the I/O 78. The UI 82 has the role of accepting input instructions from a user and informing the user of information relating to image processing. Moreover, a hard disk 84 is connected to the I/O 78. Further, the I/O 78 is connected to a communication network 90 via an I/F 86.

Figure 3:
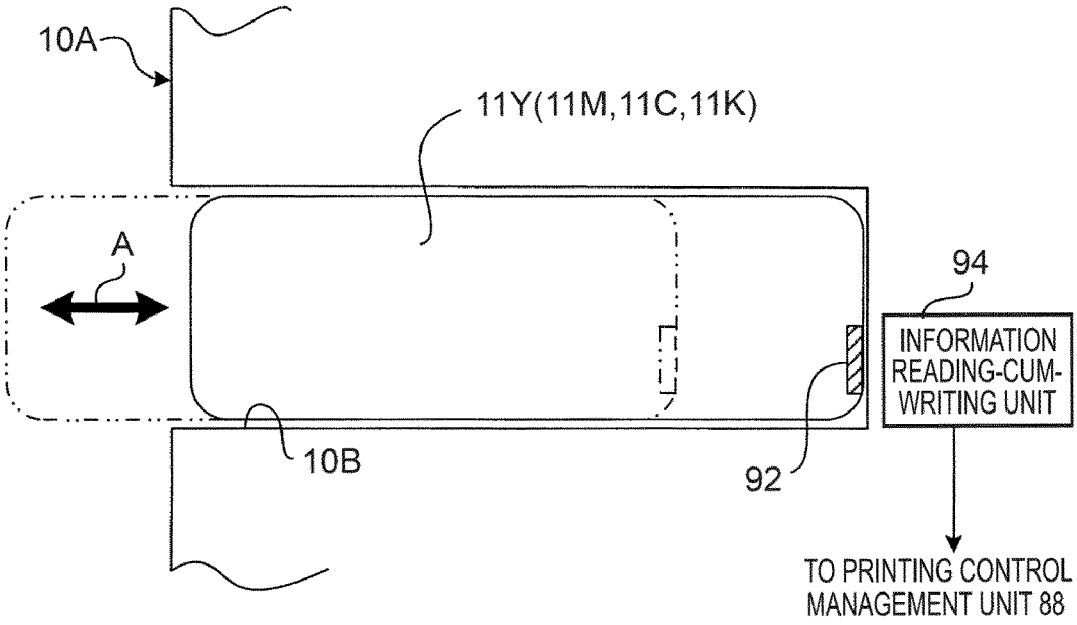
FIG. 3 is a cross-sectional diagram showing a loading section pertaining to the exemplary embodiment as seen from the right side of FIG. 1.

In FIG. 3, there is conceptually shown a state where the toner cartridges 11Y, 11M, 11C and 11K have been loaded into the loading section 10B disposed in the printer engine section 10A.

Casings of the toner cartridges 11Y, 11M, 11C and 11K are cylindrical and filled inside with the two-component developers. These toner cartridges 11Y, 11M, 11C and 11K are loaded into the loading section 10B disposed in the printer engine section 10A, whereby a drive system (gear) in the printer engine section 10A and driven systems (gears) in the toner cartridges 11Y, 11M, 11C and 11K become coupled together.

The toner cartridges 11Y, 11M, 11C and 11K eject the two-component developers toward the toner supply paths 13Y, 13M, 13C and 13K of the printer engine section 10A because of driving force received from the drive system of the printer engine section 10A.

Here, a recording medium 92 (hereinafter called "the CRUM 92") is attached to the toner cartridges 11Y, 11M, 11C and 11K.

Various types of maintenance information (CRUM information) are stored in this CRUM 92. As some of that information, toner type identification information that identifies the type of toner that is part of the two-component developer is stored in the CRUM 92.

In the deepest part of the loading section 10B of the printer engine section 10A, an information reading-cum-writing unit 94 is disposed in a position facing the CRUM 92 when the toner cartridges 11Y, 11M, 11C and 11M have been loaded. This information reading-cum-writing unit 94 may be a type that contacts a terminal disposed in the CRUM 92 and reads the information or may be equipped with a non-contact information reading function such as a so-called RFIC (radio tag).

The information reading-cum-writing unit 94 is connected to the printing control management unit 88 and is configured such that at least reading and writing of CRUM information are executed when the toner cartridges 11Y, 11M, 11C and 11K have been loaded.

Here, in the printing control management unit 88 of the present exemplary embodiment, the information reading-cum-writing unit 94 reads the identification information indicating the type of toner from the CRUM 92 and discriminates whether the toner (two-component developer) filling the toner cartridges 11Y, 11M, 11C and 11M that have been loaded is standard (hereinafter called "standard toner") or not standard (hereinafter called "toner that is not standard" or "nonstandard toner" as needed), and, on the basis of this discrimination result, processing to change the setting of conditions relating to the fixing treatment is performed.

The standard toner of the image forming apparatus 10 pertaining to the present exemplary embodiment has a low melting point in comparison to old-specification toner that had been handled as pure in old specifications (prior to the filing of the present application). In other words, the temperature necessary for the fixing treatment is relatively low, so the default value (standard fixing temperature) is set to a relatively low temperature. Because of this setting, old-specification toner is defined as being in the category of "toner that is not standard" (see definitions (1) and (2) below).

(Definition 1) Standard Toner

→Toner with the lowest melting point (even if it recycled, it falls in the category of standard as long as its melting point is the same)

(Definition 2) Toner that is Not Standard

→Toner whose melting point is high in comparison to that of the standard toner (old-specification toner or different-format toner made by the same company, or toner made by a different company)

For example, the standard fixing temperature when toner that is not standard has been used is 175° C., but the standard fixing temperature when the standard toner that is made by company A pertaining to the present exemplary embodiment has been used is 140° C., so there is a difference of +35° C. in comparison to the standard toner.

It will be noted that, although toner made by company A is pure, toner (the "old-specification toner") that had been handled as pure until the filing of the present application has a higher melting point in comparison to the standard toner applied this time and its standard fixing temperature is 165° C. (a difference of +25° C. in comparison to the standard toner).

As for this temperature setting, the processing capacity of the image forming apparatus is 20 to 30 ppm (pages per minute), and the standard fixing temperature becomes higher proportionally in superior machine types.

In the present exemplary embodiment, the correspondences shown in Table 1 below are made as setting change processing when toner that is not standard is applied.

TABLE 1

| Setting Change Target | Change Corresponding to Fixing Temperature Difference | Execution Condition |
|---|---|---|
| Fixing Temperature | Higher | Essential |
| Number of Continuous Processing Pages | Fewer | Essential |
| Continuous Processing Time Interval | Longer | Optional |
| Fixing Treatment Speed | Slower | Optional |
| Maximum Image Density | Lower | Optional |
| Cooling Fan Capacity | Stronger | Optional |

In Table 1, as the execution condition, "essential" is indicated for things whose setting must be changed in accordance with the type of toner and "optional" is indicated for things whose setting may be optionally changed. For items in the "optional" heading, it can be possible that none at all are selected or if several are combined and selected.

Figure 4:
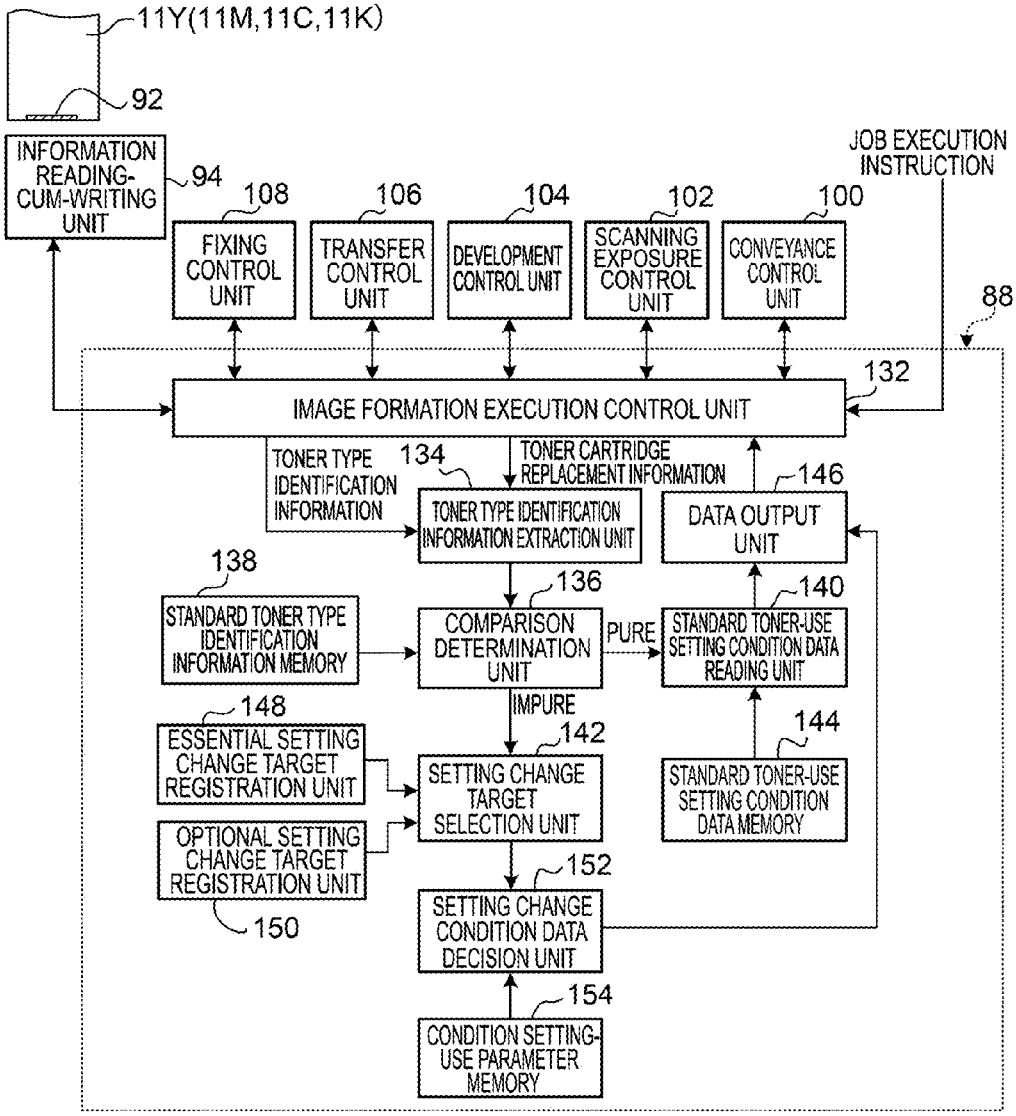
FIG. 4 is a control block diagram functionally showing control for changing a fixing temperature based on toner type.

FIG. 4 is a block diagram functionally showing control relating to the aforementioned "fixing temperature based on toner type and condition data decision of each type of setting change target" in the printing control management unit 88. It will be noted that this block diagram is one where its units are classified by function and is not intended to limit the hardware configuration of the printing control management unit 88.

An image formation execution control unit 132 is disposed in the printing control management unit 88, and the conveyance control unit 100, the scanning exposure control unit 102, the development control unit 104, the transfer control unit 106 and the fixing control unit 108 are respectively connected to the image formation execution control unit 132.

Further, a job execution instruction signal is inputted to the printing control management unit 88, and on the basis of input of this job execution instruction signal, the printing control management unit 88 controls the conveyance control unit 100, the scanning exposure control unit 102, the development control unit 104, the transfer control unit 106 and the fixing control unit 108 to execute image formation processing.

The information reading-cum-writing unit 94 is connected to the printing control management unit 88. For this reason, the printing control management unit 88 is capable of reading the information stored in the CRUM 92 attached to the toner cartridges 11Y, 11M, 11C and 11K.

A toner type identification information extraction unit 134 is connected to the image formation execution control unit 132. This toner type identification information extraction unit 134 extracts the toner type identification information from the CRUM information stored in the CRUM 92 that is accessed via the information reading-cum-writing unit 94 when toner cartridge replacement information is inputted from the image formation execution control unit 132.

The toner type identification information extraction unit 134 is connected to a comparison determination unit 136. The toner type identification information extraction unit 134 sends the extracted toner type identification information to the comparison determination unit 136.

A standard toner type identification information memory 138 is connected to the comparison determination unit 136, and when the extracted toner type identification information is inputted, the comparison determination unit 136 reads standard toner type identification information from the standard toner type identification information memory 138 and compares both to determine if the toner is standard or not standard.

A standard toner-use setting condition data reading unit 140 and a setting change target selection unit 142 are connected to the comparison determination unit 136.

When the determination result in the comparison determination unit 136 is "standard", the comparison determination unit 136 sends a seizure signal to the standard toner-use setting condition data reading unit 140. Further, when the determination result in the comparison determination unit 136 is "not standard (nonstandard)", the comparison determination unit 136 sends a seizure signal to the setting change target selection unit 142.

A standard toner-use setting condition data memory 144 is connected to the standard toner-use setting condition data reading unit 140. For this reason, when the standard toner-use setting condition data reading unit 140 receives the seizure signal from the comparison determination unit 136, the standard toner-use setting condition data reading unit 140 reads standard toner-use setting condition data from the standard toner-use setting condition data memory 144. The standard toner-use setting condition data reading unit 140 sends the read standard toner-use setting condition data to the image formation execution control unit 132 via a data output unit 146. In the image formation execution control unit 132, an instruction is developed to each unit and executed.

An essential setting change target registration unit 148 and an optional setting change target registration unit 150 are connected to the setting change target selection unit 142. When the setting change target selection unit 142 receives a seizure signal from the comparison determination unit 136, the setting change target selection unit 142 selects setting change targets from the essential setting change target registration unit 148 and the optional setting change target registration unit 150.

In the present exemplary embodiment, as shown in Table 1, the essential setting change targets are "fixing temperature" and "number of continuous processing pages" and the optional setting change targets are "continuous processing time interval", "fixing treatment speed", "maximum image density" and "cooling fan capacity".

The setting change target selection unit 142 is connected to a setting change condition data decision unit 152. Further, a condition setting-use parameter memory 154 is connected to the setting change condition data decision unit 152. The setting change condition data decision unit 152 decides condition data of the selected setting change targets.

As for this decision, "fixing temperature", which is an essential setting change target, is decided first, and the rest are determined in stages beforehand in accordance with a difference between the decided fixing temperature and the fixing temperature when the standard toner has been used. For example, in Table 1, in the case of "number of continuous processing pages", this is "fewer" than when the standard toner has been used, and the degree to which this is to be made fewer is prepared in several stages such that the number of continuous processing pages is made fewer the larger that the temperature difference becomes. It will be noted that when the toner is toner that is not standard, the degree of change may also be determined uniformly.

The condition data that have been decided by the setting change condition data decision unit 152 are sent to the image formation execution control unit 132 via the data output unit 146. In the image formation execution control unit 132, an instruction is developed to each unit and executed.

The action of the present exemplary embodiment will be described below.

(Image Formation Procedure)

Image data are converted into color material tone data of the four colors of yellow (Y), magenta (M), cyan (C) and black (K) and are sequentially outputted to the exposure unit 40. The exposure unit 40 emits the exposure light beams L in accordance with the color material tone data of each color and performs scanning exposure on the photoconductors 28 such that latent images (electrostatic latent images) are formed.

The electrostatic latent images that have been formed on the photoconductors 28 are made manifest as toner images of each color of yellow (Y), magenta (M), cyan (C) and black (K) by the development units 31 (development). Then, the toner images of each color that have been sequentially formed on the photoconductors 28 of the image forming units 12Y, 12M, 12C and 12K are sequentially multiply transferred onto the intermediate transfer belt 16 by the four primary transfer rolls 18Y, 18M, 18C and 18K.

The toner images of each color that have been multiply transferred onto the intermediate transfer belt 16 are secondarily transferred onto the conveyed recording paper P by the secondary transfer roll 20. Then, the toner images of each color on the recording paper P are fixed by the fixing device 60, and the recording paper P after fixing is discharged into the discharge tray 68.

Residual toner and paper dust are removed by the cleaning units from the surfaces of the photoconductors 28 after the step of transferring the toner images has ended. Further, residual toner and paper dust on the intermediate transfer belt 16 are removed by the cleaning device 30.

(Control to Change Fixing Treatment Conditions)

Figure 5:
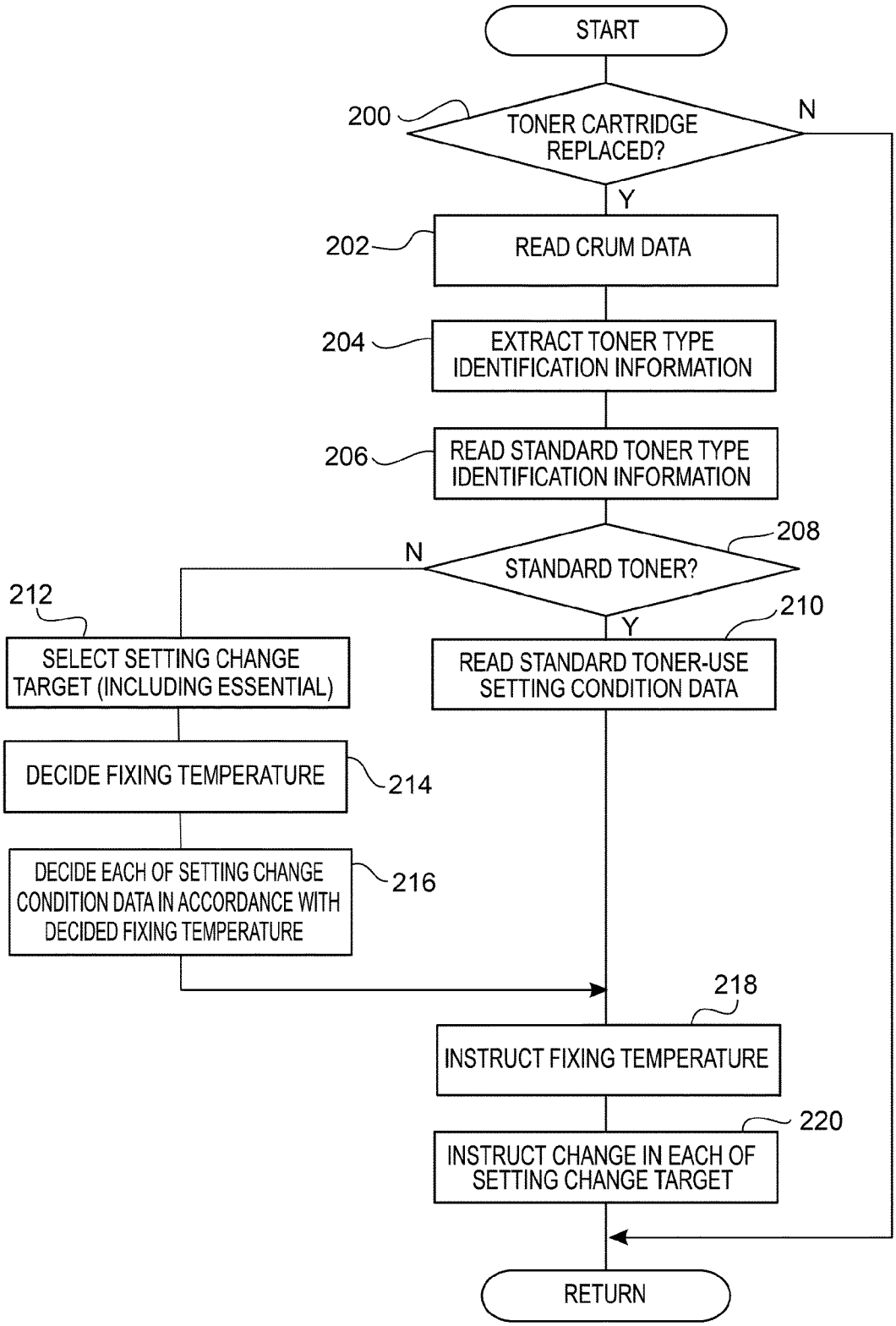
FIG. 5 is a flowchart showing a control routine for changing the fixing temperature based on toner type.

A procedure to change fixing treatment conditions based on toner type will be described on the basis of the flowchart of FIG. 5.

In step 200, it is judged whether or not the toner cartridges 11Y, 11M, 11C and 11K have been replaced. When the determination is NO, this routine ends.

When the determination is YES in step 200, the routine moves to step 202, where the CRUM information stored in the CRUM 92 is read.

In the next step 204, the identification information that identifies the toner type is extracted from the CRUM information that has been read. Then, the routine moves to step 206.

In step 206, the standard toner identification information is read. Then, the routine moves to step 208, where the identification information that has been extracted and the standard toner identification information are compared.

When the toner is determined to be the standard toner as a result of this comparison (YES determination in step 208), the routine moves to step 210, where the standard toner-use setting condition data are read. Then, the routine moves to step 218.

Further, when the toner is determined to be toner that is not standard (nonstandard toner) in step 208 (NO determination), the routine moves to step 212, where the setting change targets are selected.

In this selection, "fixing temperature" and "number of continuous processing pages" are selected as the essential setting change targets, and at least one is selected from among "continuous processing time interval", "fixing treatment speed", "maximum image density" and "cooling fan capacity" as the optional setting change target. Or, it may be possible that none are selected.

In the next step 214, the fixing temperature when toner that is not standard has been used is decided. Next, the routine moves to step 216, where each of setting change condition data is decided in accordance with the decided fixing temperature. Then, the routine moves to step 218.

It will be noted that the degree of change of the setting change condition data with respect to when using the standard toner increases or decreases proportionally to the fixing temperature, but it may also be decided uniformly. That is, in the case this time, it is understood that the fixing temperature is higher when toner that is not standard is used, so it suffices to change each of data by a constant percentage determined beforehand.

More specifically, when toner that is not standard has been used, there may also be quantitative changes where the number of continuous processing pages is made fewer by N sheets, the continuous processing time interval is made longer by t seconds, the fixing treatment speed is made slower by v mm/sec, the maximum image density is made lower by D, and, as for the cooling fan capacity, the fan rotational speed is made faster by R rpm.

In step 218, the fixing temperature is instructed. Then, the routine moves to step 220, where change instructions are made to each of setting change target. Then, this routine ends.

It will be noted that, in the present exemplary embodiment, the printer 10 is configured to read the toner type information from the CRUM 92, but the printer 10 may also be configured such that a user directly sees a model number or the like when replacing the toner cartridges 11Y, 11M, 11C and 11K or the like and discriminates and inputs the toner type.

(Modification)

Figure 6A:
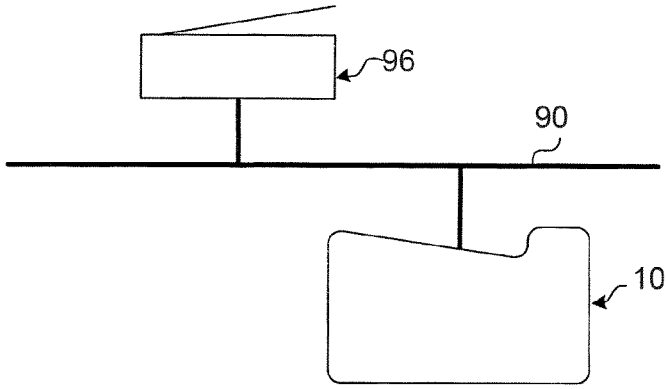
FIG. 6A pertains to a modification and is a general configural diagram of feedback control for setting the fixing temperature.

Here, in the present exemplary embodiment, the printer 10 is configured to adjust the fixing temperature and the like automatically when toner that is not standard has been used, but it is also possible for the printer 10 to discriminate and feed-back the state of image quality when that toner that is not standard has been used. In this case, a scanner 96 becomes necessary in addition to the printer 10 of the present exemplary embodiment (see FIG. 6A).

Figure 6B:
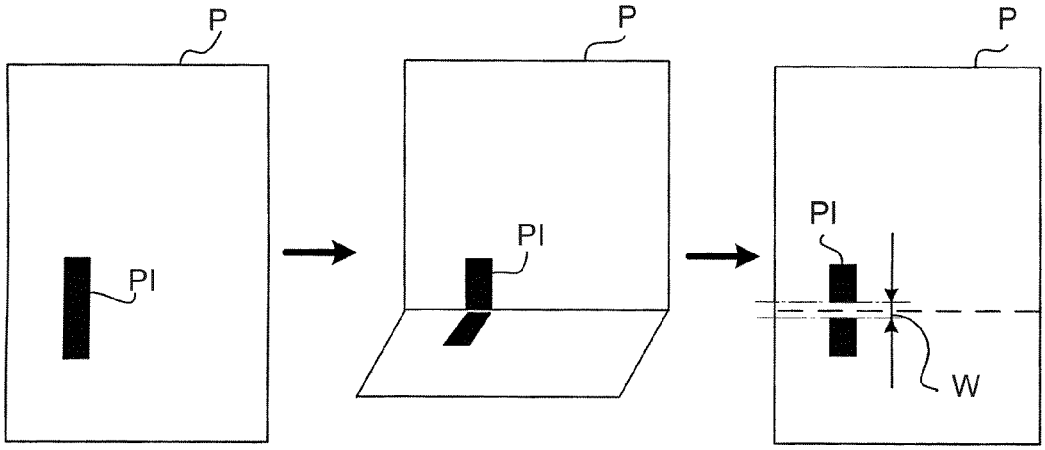
FIG. 6B pertains to the modification and is a front view of paper showing a reference image formation procedure.

That is, as shown in FIG. 6B, when it has been ascertained that toner that is not standard will be used, the fixing temperature and the like are changed by uniform setting change condition data determined beforehand, and image formation of a reference image PI (e.g., a line image of a constant width dimension).

Thereafter, when a portion of outputted paper P pertaining to the reference image PI is folded and opened, discontinuity occurs in the reference image PI (line image) because of the degree of fixing.

Figure 6C:
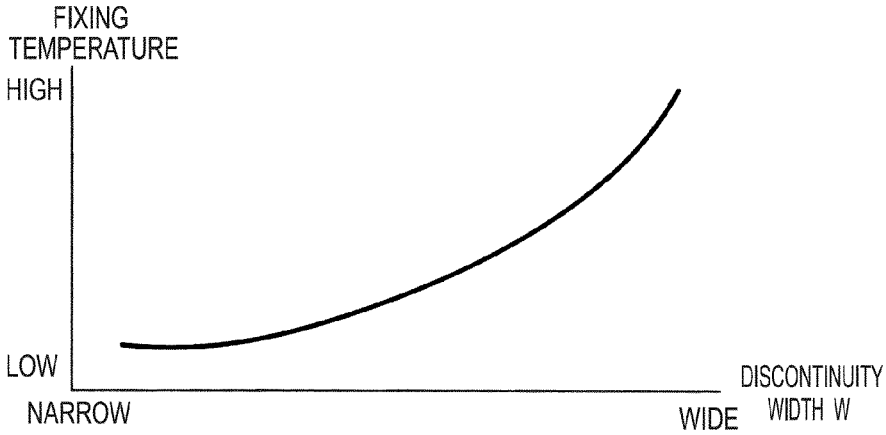
FIG. 6C pertains to the modification and is a characteristic diagram showing a discontinuity width W of the reference image and the fixing temperature.

This image P is read by the scanner 96 to measure a discontinuity width W of the reference image PI (line image). It is known that the discontinuity width is proportional to a difference $\Delta t$ in the fixing temperature t (see FIG. 6C), so an optimum fixing temperature is decided on the basis of this measured discontinuity width W of the reference image PI (line image). As for setting of the fixing temperature in this feedback, time for image formation on the paper P and measurement of the discontinuity width becomes necessary, but image formation under the fixing temperature that has been set on the basis of this discontinuity width W does not affect image quality even with toner that is not standard.

It will be noted that, in the present exemplary embodiment, the scanner 96 was used to automatically measure the discontinuity width W, but a user may also use a ruler to directly measure and input by hand the discontinuity width.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heated body whose fixing temperature applied to toner is changed and which is heated in accordance with a type of toner that has been discriminated by a toner type discriminating unit that discriminates types of toner classified at least as a result of their melting points differing, when toner with a relatively high melting point having been used, the fixing device being rotated on the basis of a limiting control unit that limits a number of sheets of recording paper that can be continuously fixed.

2. The fixing device according to claim 1, wherein when toner with a relatively low melting point is defined as standard toner, a standard fixing temperature is set on the basis of the standard toner, and when the toner that has been discriminated by the toner type discriminating unit is not the standard toner, the heated body is heated so as to increase the fixing temperature to a temperature that is higher than the standard fixing temperature.

3. The fixing device according to claim 2, wherein when the toner that has been discriminated by the toner type discriminating unit is not the standard toner, the fixing device lengthens a paper interval between the sheets of recording paper that are continuously fixed.

4. The fixing device according to claim 2, wherein when the toner that has been discriminated by the toner type discriminating unit is not the standard toner, the fixing device lengthens a paper interval between the sheets of recording paper that are continuously fixed on the basis of a temperature difference between the standard fixing temperature corresponding to the standard toner and the fixing temperature corresponding to the toner that is not the standard toner.

5. The fixing device according to claim 2, wherein when the toner that has been discriminated by the toner type discriminating unit is not the standard toner, the fixing device slows a fixing treatment speed with respect to the sheets of recording paper.

6. The fixing device according to claim 2, wherein when the toner that has been discriminated by the toner type discriminating unit is not the standard toner, the fixing device slows a fixing treatment speed with respect to the sheets of recording paper on the basis of a temperature difference between the standard fixing temperature corresponding to the standard toner and the fixing temperature corresponding to the toner that is not the standard toner.

7. The fixing device according to claim 2, wherein when the toner that has been discriminated by the toner type discriminating unit is not the standard toner, the fixing device fixes a toner image whose maximum image density has been lowered.

8. The fixing device according to claim 2, wherein when the toner that has been discriminated by the toner type discriminating unit is not the standard toner, the fixing device fixes a toner image whose maximum image density has been lowered on the basis of a temperature difference between the standard fixing temperature corresponding to the standard toner and the fixing temperature corresponding to the toner that is not the standard toner.

9. The fixing device according to claim 2, wherein when the toner that has been discriminated by the toner type discriminating unit is not the standard toner, a cooling capacity degree resulting from a cooling fan is increased.

10. The fixing device according to claim 2, wherein when the toner that has been discriminated by the toner type discriminating unit is not the standard toner, the fixing device reads correction information from a reference image on a sheet of the recording paper to which a fixing treatment has been administered under a fixing temperature determined beforehand and sets an appropriate fixing temperature of the toner that is not the standard toner on the basis of the correction information.

11. The fixing device according to claim 1, wherein the fixing device gives notification of information with which a difference in amounts of electrical power in a state of use between when the toner is the standard toner and when the toner is not the standard toner becomes clear.

12. The fixing device according to claim 1, wherein the toner type discriminating unit comprises a storage medium that is attached to a toner cartridge filled with toner and in which is stored information of the type of toner with which the toner cartridge is filled and a reading unit that reads the toner type information stored in the storage medium when the toner cartridge has been loaded into a loading section.

13. An image forming apparatus that forms an image on recording paper using the fixing device according to claim 1.

14. A recording medium in which is recorded a fixing treatment program that discriminates types of toner classified at least as a result of their melting points differing, changes fixing temperatures applied to the toner to temperatures suited thereto in accordance with the type of toner that has been discriminated, and limits a number of sheets of recording paper that can be continuously fixed when toner with a relatively high melting point has been used.

15. The recording medium in which is recorded the fixing treatment program according to claim 14, wherein when toner with a relatively low melting point is defined as standard toner, a standard fixing temperature is set on the basis of the standard toner, and when the toner that has been discriminated is not the standard toner, the fixing temperature is increased to a temperature that is higher than the standard fixing temperature.

16. The recording medium in which is recorded the fixing treatment program according to claim 15, wherein when the toner that has been discriminated is not the standard toner, a treatment interval is lengthened during continuous treatment on the basis of a temperature difference between the standard fixing temperature corresponding to the standard toner and the fixing temperature corresponding to the toner that is not the standard toner.

17. The recording medium in which is recorded the fixing treatment program according to claim 15, wherein when the toner that has been discriminated is not the standard toner, a fixing treatment speed is slowed on the basis of a temperature difference between the standard fixing temperature corresponding to the standard toner and the fixing temperature corresponding to the toner that is not the standard toner.

18. The recording medium in which is recorded the fixing treatment program according to claim 15, wherein when the toner that has been discriminated is not the standard toner, a maximum image density is lowered on the basis of a temperature difference between the standard fixing temperature corresponding to the standard toner and the fixing temperature corresponding to the toner that is not the standard toner.

19. The recording medium in which is recorded the fixing treatment program according to claim 15, wherein when the toner that has been discriminated is not the standard toner, a cooling capacity degree resulting from a cooling fan is increased.

20. The recording medium in which is recorded the fixing treatment program according to claim 15, wherein when the toner that has been discriminated is not the standard toner, correction information from a reference image on a sheet of the recording paper to which a fixing treatment has been administered under a fixing temperature determined beforehand is read and an appropriate fixing temperature of the toner that is not the standard toner is set on the basis of the correction information.

21. The recording medium in which is recorded the fixing treatment program according to claim 14, wherein the fixing treatment program gives notification of information with which a difference in amounts of electrical power in a state of use between when the toner is the standard toner and when the toner is not the standard toner becomes clear.

22. A fixing treatment method comprising:

discriminating types of toner classified at least as a result of their melting points differing;

changing fixing temperatures applied to the toner to temperatures suited thereto in accordance with the type of toner that has been discriminated; and limiting a number of sheets of recording paper that can be continuously fixed when toner with a relatively high melting point has been used.

* * * * *